United States Patent [19]

Bowman

[11] 4,148,465

[45] Apr. 10, 1979

[54] PORTABLE WINCH STAND

[76] Inventor: Donald W. Bowman, 4216 Cuthbertson, Flint, Mich. 48507

[21] Appl. No.: 828,346

[22] Filed: Aug. 29, 1977

[51] Int. Cl.[2] ..... B66D 1/72

[52] U.S. Cl. ..... 254/186 HC; 254/139.1; 114/210; 9/35

[58] Field of Search ..... 254/139.1, 187.4, 186 R, 254/186 HC, 187 R; 248/223.4, 224.1, 122; 114/210; 9/35, 34

[56] References Cited

U.S. PATENT DOCUMENTS

| | | | |
|---|---|---|---|
| 965,648 | 7/1910 | Nace | 248/223.4 X |
| 1,675,930 | 7/1928 | Gabrielson et al. | 114/210 |
| 1,824,339 | 9/1931 | Foradas et al. | 254/139.1 X |
| 2,810,984 | 10/1957 | Gokey | 254/139.1 UX |

*Primary Examiner*—Trygve M. Blix
*Assistant Examiner*—Jerold M. Forsberg
*Attorney, Agent, or Firm*—J. L. Jones, Sr.

[57] ABSTRACT

A portable winch stand can be easily mounted on a boat, dock or other required facility. The winch stand is useful for raising heavy boat anchors, and the like, can easily be assembled for use, and can be compactly folded and stored.

1 Claim, 4 Drawing Figures

PORTABLE WINCH STAND

BACKGROUND OF THE INVENTION

The portable winch stand of this invention is classified in Class 114/210 and 254/187.

In U.S. Pat. No. 3,853,083 issued Dec. 10, 1974, Jones teaches a floatable resilient body disposed for free movement about an anchor cable and the body can engage an anchor on raising, preventing the anchor from damaging the boat. Mayfield, in U.S. Pat. No. 3,906,882, issued Sept. 23, 1975, discloses an anchor mount assembly disposed on a boat and includes means for preventing excessive anchor movement on storage out of water. Oglesby, in U.S. Pat. No. 3,331,349, issued July 18, 1967, discloses a boat anchor reel having an anchor reel and a separate cooperative torque input shaft means. Anderson, in U.S. Pat. No. 3,242,894 issued Mar. 29, 1966, discloses a remote controlled automatic power operated winch and boom for boats.

SUMMARY OF THE INVENTION

The portable winch stand of this invention is foldable, providing easy assembly and mounting for use as a winch stand, as well as simple compact storage. A conventional winch is secured on the top terminus of a stanchion, the winch base normal to the stanchion length axis. A flat base plate is secured on the bottom terminus of the stanchion, normal to the stanchion length axis. This stanchion base plate is slidably securable in a dovetail permanent base plate. The stanchion base plate and a permanent base plate, dovetailed together, are locked together by an index pin disposed in a pair of indexed apertures in the pair of base plates. The permanent base plate is secured to a boat deck, boat dock, or other facility as required. Below the winch base, a stanchion arm has a first stanchion arm terminus secured by a hinge means to the stanchion, the arm folding out and extending normal to the stanchion, and folding flat and parallel to the stanchion. Anchor rope guide means are disposed at the stanchion arm second terminus opposed to the stanchion arm first terminus. The anchor rope guide means provides a rope securing means while weighing the anchor.

Included in the objects of this invention are:

To provide a portable winch stand easily mountable on a boat, dock, or like facility.

To provide a portable winch stand that can be folded and stored, and then easily assembled for use.

To provide a winch stand that can weigh a heavy anchor, without damaging the anchored boat.

Other objects and advantages of this invention are taught in the following description and claims.

BRIEF DESCRIPTION OF THE DRAWINGS

The description of this invention is to be read in conjunction with the following drawings.

DESCRIPTION OF THE PREFERRED EMBODIMENT OF THE INVENTION

Figure 1:
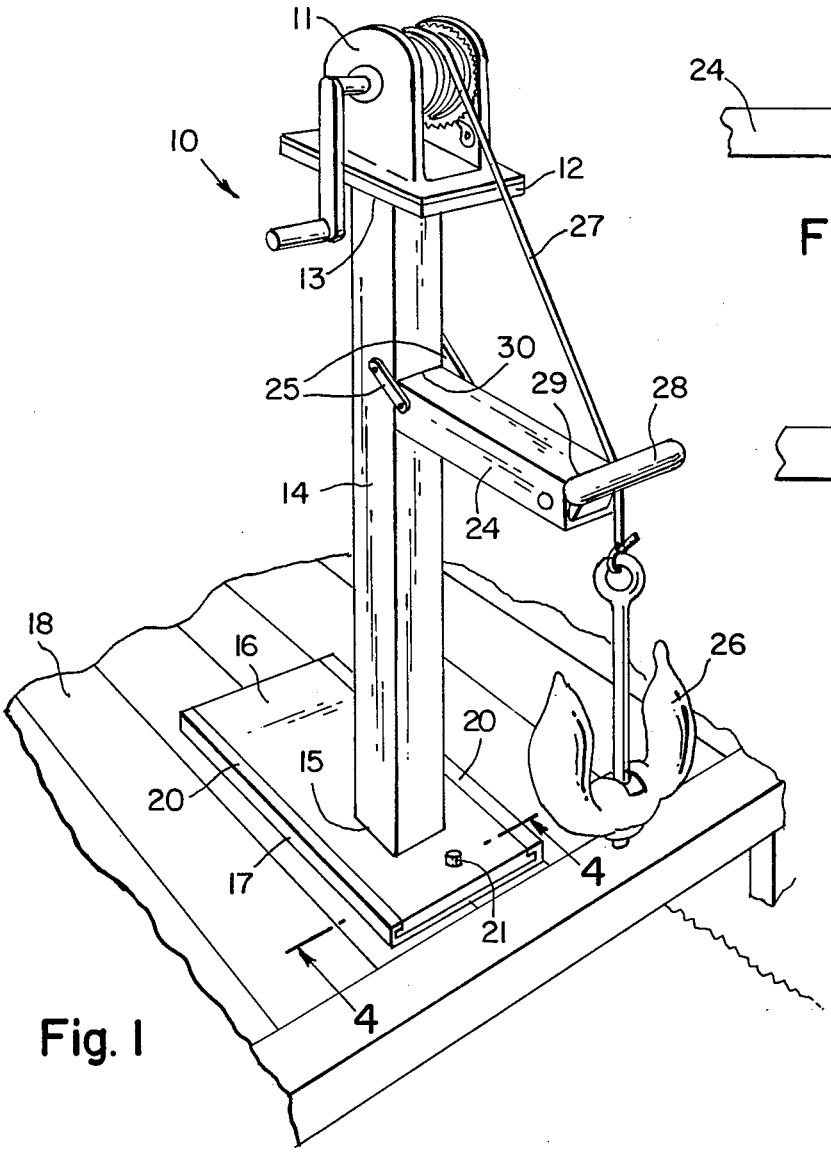
FIG. 1 is an elevational perspective view of the portable winch stand of this invention, disposed on a boat deck and suitable for functional use.
Figure 4:
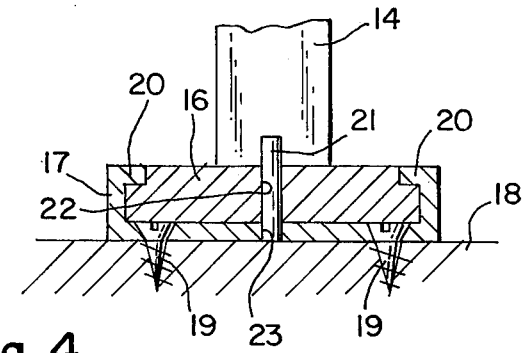
FIG. 4 is a partial sectional view of the base of the portable winch stand of this invention through 4—4 of FIG. 1.

Referring to FIGS. 1 and 4 in detail, the portable winch stand 10 has a conventional winch 11 disposed on a flat winch base plate 12. The winch base plate 12 is permanently secured normally to the first terminus 13 of the stanchion 14. The stanchion 14, of required length, has a second terminus 15 permanently secured normally to a stanchion base plate 16. The base plate 16 is slidably dovetailed into a permanent base plate 17, which is secured permanently to a boat deck 18, dock, or the like facility, by fasteners 19 or the like. The pair of short channel legs 20 of plate 17, secure the base plate 16 in a locked position. The locked position is further secured by the index pin 21, indexing and penetrating through both base plate 16 and permanent base plate 17 and their aligned apertures 22 and 23 respectively.

A hinged stanchion arm 24 is secured by a hinge means 25 at the first arm terminus 30 to the stanchion 14, operatively extending out normal to the upright operative stanchion 14 position. Other hinge means than the depicted hinge 25 are equivalently useful. The length of arm 24 is the required value. The stanchion arm 24 can be folded up parallel and adjacent to the stanchion 14 when it is not required to be used. The extended arm 24, as illustrated in FIG. 1, provides means of lifting a heavy anchor 26 and bringing the anchor 26 on board the boat, without damaging the boat structure.

Anchor rope 27 is guided in the anchor weighing operation by the rope guide 28 disposed at the second stanchion arm terminus 29. Rope guide 28 is an annular or doughnut ring affixed to the terminus 29. The anchor rope 27 is guided through the central doughnot aperture.

Figure 2:
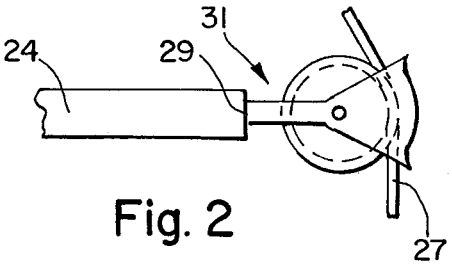
FIG. 2 is an elevational view of a roller anchor rope guide useful in this invention.

FIG. 2 illustrates a conventional pulley rope guide 31 providing a guide track for rope 27 at the second terminus 29 of arm 24.

Figure 3:
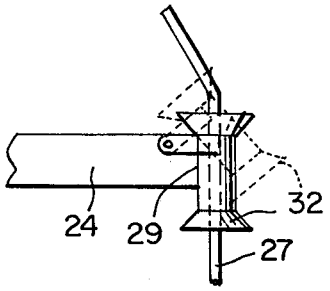
FIG. 3 is an elevational view of another anchor rope guide useful in this invention.

FIG. 3 illustrates another conventional tubular sleeve rope guide 32 providing a guide track for rope 27 at the second terminus 29 of arm 24.

The dimensions and strengths of the components of the portable winch stand are the required values. The materials of construction are those conventionally required.

Other means can provide the easy securing together of base plate 16 and permanent base plate 17, than the equivalent use of dovetail joint as described above.

Many modifications in the portable winch stand can be made in the light of my teachings. It is understood that within the scope of the claims, the invention can be practiced otherwise than as described.

I claim:

1. A portable winch stand combination comprising:
   - a winch having a flat plate winch base,
   - a stanchion having a required length, said stanchion permanently secured normally to said winch base at a first stanchion terminus,
   - a stanchion base plate permanently secured normally to said stanchion at a stanchion second terminus,
   - a stanchion arm pivotedly hinged at a first stanchion arm terminus adjacent to said stanchion at a selected distance below said winch base, said stanchion arm adapted to abutt said stanchion at said first stanchion arm terminus, on extension of said arm, an anchor rope guide means secured at the second stanchion arm terminus, providing a guide means for an anchor rope, and, a permanent base plate, adapted for securing to a boating facility, said permanent base plate and said stanchion base plate adapted to slidably dovetail together and index and secure together, utilizing an index pin indexed into coadjacent apertures in said stanchion base plate and said permanent base plate, whereby, said portable winch stand can be mounted and secured on said permanent base plate and operatively engaged to weigh an anchor on the extended stanchion arm and anchor rope guide, and whereby said stanchion arm can be folded upwardly against said stanchion on storage of said winch stand, minimizing protuberances and storage volume of said winch stand.

* * * * *